US006108856A

United States Patent [19]

Shary et al.

[11] Patent Number: 6,108,856

[45] Date of Patent: Aug. 29, 2000

[54] MOLDED PAD DRIVER

[75] Inventors: Kenneth L. Shary, Twinsburg; John D. Blazek, Willoughby, both of Ohio

[73] Assignee: The Malish Corporation, Willoughby, Ohio

[21] Appl. No.: 08/947,699

[22] Filed: Oct. 9, 1997

[51] Int. Cl.[7] ..... A47L 11/164

[52] U.S. Cl. ..... 15/230.17; 15/98

[58] Field of Search ..... 15/230.17, 230.19, 15/98; 451/409, 507, 514

[56] References Cited

U.S. PATENT DOCUMENTS 3,115,660 12/1963 Hunt ..... 15/230.17
3,823,516 7/1974 Christian ..... 15/98

FOREIGN PATENT DOCUMENTS 2 132 078 7/1984 United Kingdom ..... 15/230.17

OTHER PUBLICATIONS

EWU Products informational ad on Padholder Series 400, 1991.
A sample piece of a prior art pad driver.
Drawings (Exhibits 1 and 2) showing a prior art molding apparatus.
Drawing (Exhibit 3) showing detail of a prior art hook or arrowhead–like member.

*Primary Examiner*—Theresa T. Snider
*Attorney, Agent, or Firm*—Watts, Hoffmann, Fisher & Heinke Co.

[57] ABSTRACT

A molded pad driver for use with floor maintenance machines including structure that defines a circular disc-like body, the body defining a driving surface that is abuttably engageable with a driven surface of a floor maintenance pad to which it is attached. The driving surface is at least partially defined by a plurality of sets of protrusions with each set of protrusions preferably consisting of a plurality of protruding members arranged in a circular patterns, such that each protruding member of a set is at a slightly different orientation with respect to all of the members of a set, as viewed from a plane parallel to a plane of the pad driver. Each protruding member preferably consists of an arrowhead member including a stanchion that extends axially from a base surface on the pad driver and terminates in an arcuate crossbar that extends generally laterally with respect to the rotational axis of the pad driver. Each arrowhead member defines a camming nose which facilitates release of the arrowhead member from a molding surface used to mold the arrowhead member.

13 Claims, 4 Drawing Sheets

MOLDED PAD DRIVER

TECHNICAL FIELD

The present invention relates generally to floor cleaning and maintenance machines and, in particular, to a pad driver and method for molding a pad driver.

BACKGROUND ART

Floor maintenance machines used for cleaning, polishing and waxing floors typically include a "pad driver" that is rotatably connected to a drive motor. The pad driver itself is considered a driving element and its purpose is to provide the driving force to a cleaning, polishing or abrasive pad that is attached to the pad driver. In order to provide the required driving force, the surface of the pad driver must establish a frictional coupling between itself and the pad.

Several methods can be used to provide the required frictional coupling. In one method, the pad driver is molded with a plurality of axially extending elements which are intended to, at least partially, penetrate the cleaning pad that is generally made of a fibrous material. In the past, the molding of these driving elements integrally with the pad driver have required complex molds which are not only costly to manufacture, but are costly to maintain. These prior pad driver molds have included a series of fixed and movable bars which define cavities for the axially extending driving elements.

It has also been found that molded pad drivers in the past have had less than optimum gripping contact with the attached cleaning pad. It is desirable to have an increased gripping force between the pad driver and the cleaning pad.

DISCLOSURE OF INVENTION

The present invention provides a new and improved pad driver and method for making a pad driver for use with a floor maintenance machine.

In accordance with the invention, the pad driver includes structure that defines a circular disc-like body that preferably includes means for securing a floor maintenance pad. The body defines a driving surface that is abuttably engageable with a driven surface formed on the floor maintenance pad. It is operative to exert driving forces on the maintenance pad when the pad driver is rotated by a motor forming part of the floor maintenance machine. The driving surface of the disclosed pad driver defines a plurality of sets of protrusions. According to the invention, each set of protrusions comprises a plurality of protruding members that are arranged in a circular pattern, such that each protruding member of a set is at a slightly different orientation with respect to all other members of the set, as viewed from a plane parallel to a plane of the pad driver.

According to a more preferred embodiment, each protruding member of a set comprises an arrowhead member that is defined by a stanchion that extends from a base surface on the pad driver and terminates in a crossbar. The crossbar extends generally laterally with respect to a rotational axis of the pad driver, whereas the stanchion extends generally actually with respect to the pad driver.

According to the preferred and illustrated embodiment, the crossbar of each arrowhead member is arcuate. In the illustrated embodiment, each arrowhead member defines a camming nose having a camming surface for facilitating release of the arrowhead member from a molding surface that is used to mold the arrowhead member. In the preferred and illustrated embodiment, the arrowhead members of a set are arranged on a circle with each member being at a common radial distance as measured from a center of the circle and which the members are located. In addition, the set of arrowhead members are located on the pedestal that is spaced axially with respect to the overall pad driving surface. The arrowhead member preferably include a radius outer surface and the stanchion and crossbars are chamfered. The top surface of each arcuate crossbar is preferably angled downwardly towards the base surface. In the illustrated embodiment, distal ends of the crossbar are triangular in cross-section.

The disclosed pad driver is made by molding sets of protrusions that extend axially from a driving surface defined by the pad driver. Each set of protrusions is molded by first forming a plurality of recesses near a distal end of the cavity pin. The distal end of the cavity pin is then positioned within the bore defined by a cavity plate such that a circumferential side of each recess is enclosed, leaving an axial opening through which molding compound is communicated to each recess from a mold cavity portion in which at least partially forms the body of the pad driver. Filling the mold cavity with molding compound ultimately fills each cavity recess defined by the cavity pin. The pin is then moved relative to the cavity plate, such that the peripheral sides of each recess is exposed. The molded pad is then urged away from the cavity pin such that protrusions formed by the recesses move out of the recesses defined by the cavity pin.

According to the preferred method, each recess in the cavity pin defines a camming surface, such that when the molded pad is urged away from the cavity pin, the protrusions are cammed out of the recesses.

Additional features of the invention will become apparent and a fuller understanding obtained by reading the following detailed description made in connection with the accompanying drawings.

BEST MODE FOR CARRYING OUT THE INVENTION

Figure 1:
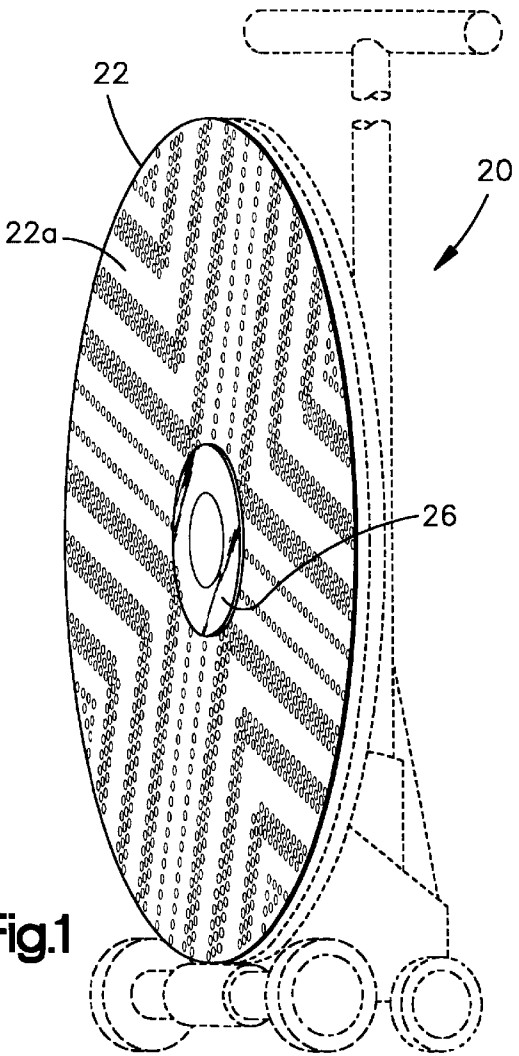
FIG. 1 is a schematic representation of a floor maintenance machine to which is mounted a pad driver constructed in accordance with the preferred embodiment of the invention.

FIG. 1 illustrates, somewhat schematically, a floor maintenance machine 20 to which is mounted a pad driver 22 constructed in accordance with the preferred embodiment of the invention. The pad driver 22 is operatively coupled to a drive motor (not shown) forming part of the floor maintenance machine 20, so that the pad driver 22 is rotated by the drive motor whenever it is energized. As is conventional, a stripping, scrubbing or polishing pad (not shown) is coupled to and abutably engages a driving surface 22*a* of the pad driver 22. The pad is maintained in its operative position by a coupling hub 26 which may take various forms. Examples of suitable couplers are illustrated in U.S. Pat. Nos. 5,400,461 and 5,645,365 entitled "Locking Coupler For Floor Maintenance Pad" and "Coupler Device For Floor Maintenance Machine", respectively, both of which are hereby incorporated by reference.

Figure 2:
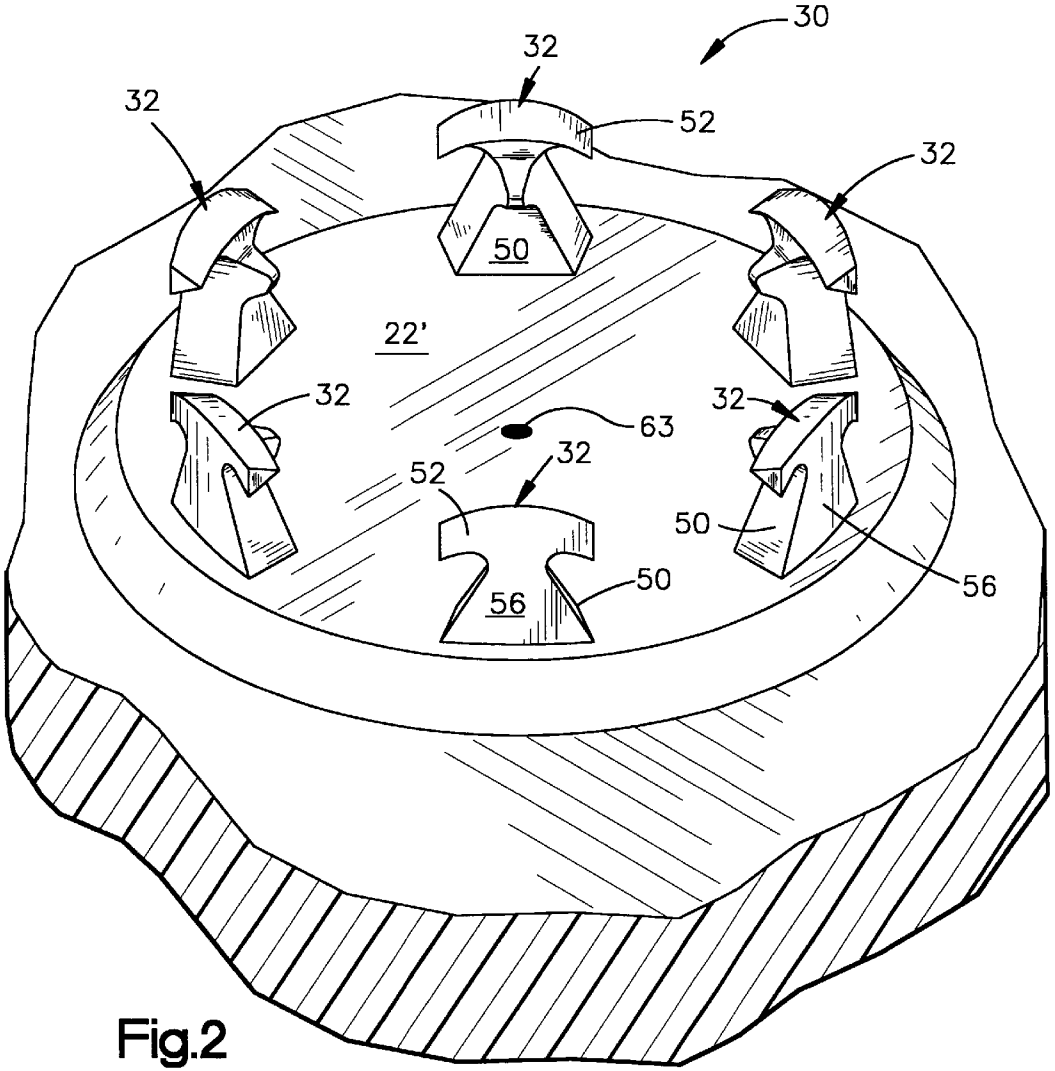
FIG. 2 is a fragmentary perspective view of the pad driver shown in FIG. 1.
Figure 3:
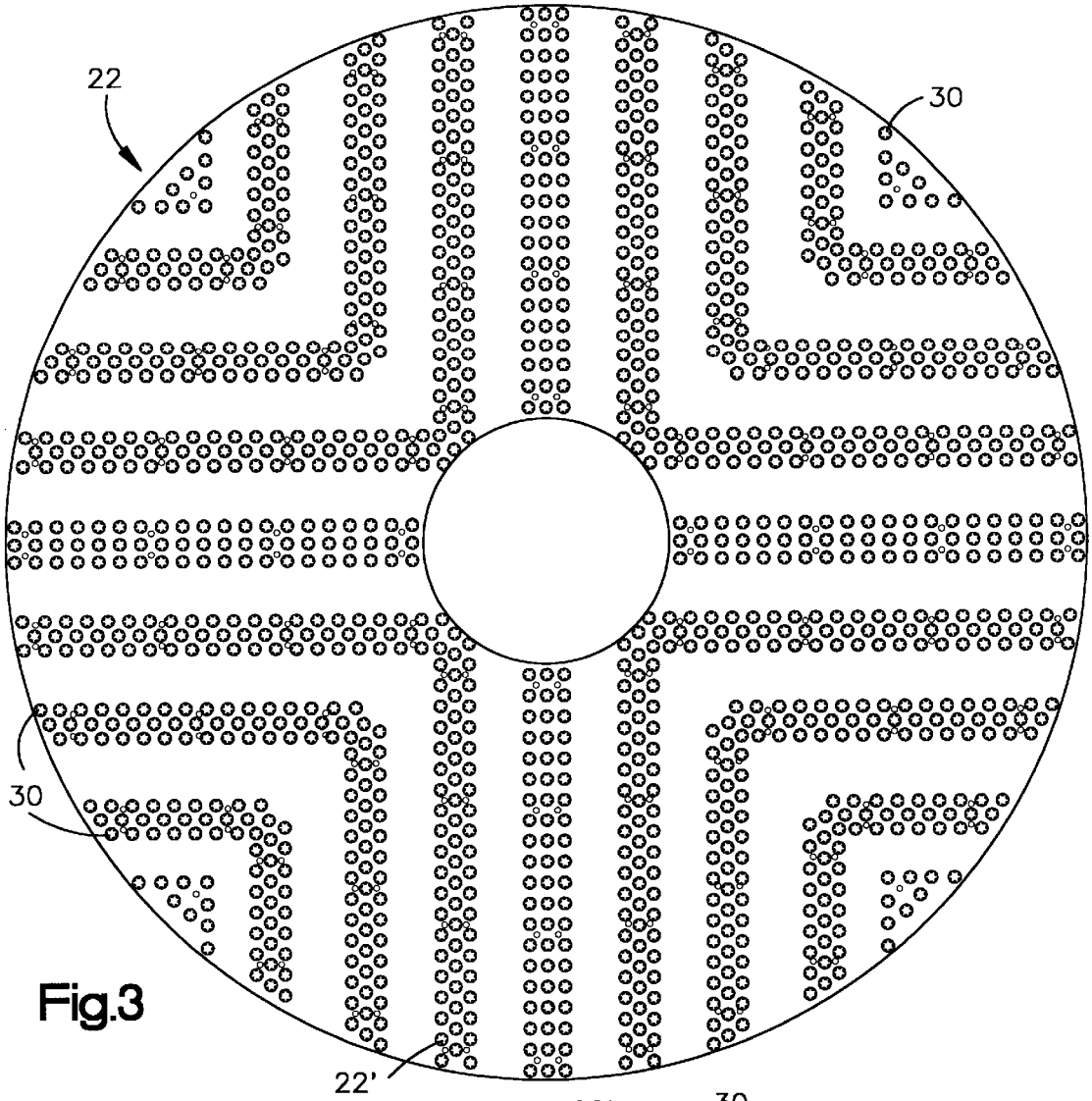
FIG. 3 is a side elevational view of the pad driver.
Figure 3A:
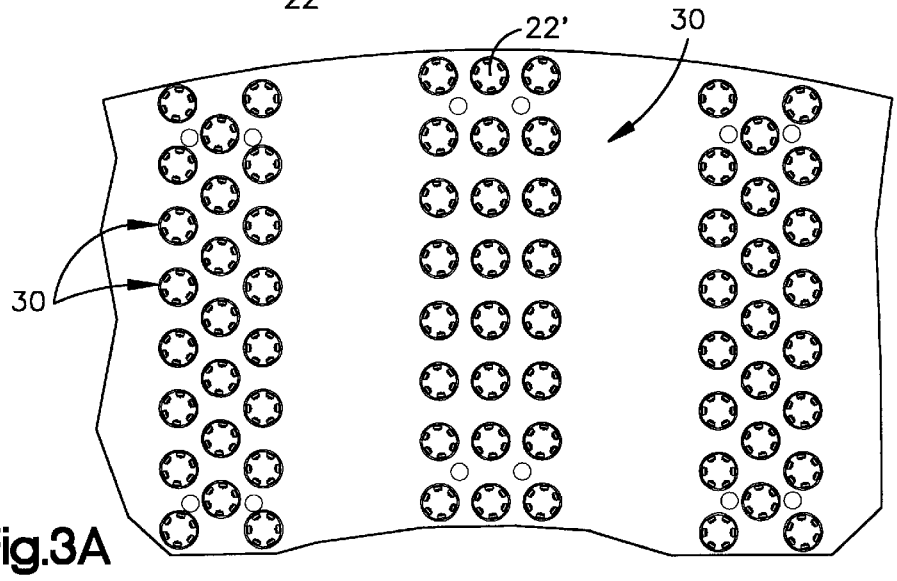
FIG. 3A is an enlarged fragmentary side elevational view of the pad driver showing additional details.
Figure 8:
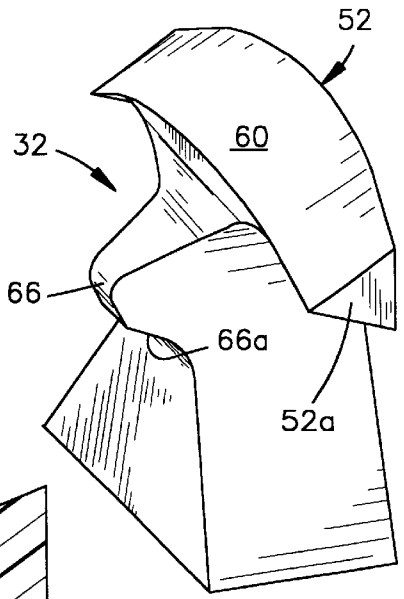
FIG. 8 is perspective view of the arrowhead member.
Figure 7:
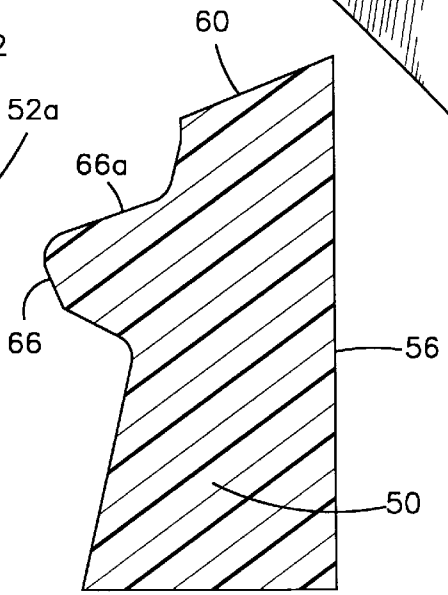
FIG. 7 is a sectional view of the arrowhead member as seen from the plane indicated by the line 7—7 in FIG. 6.

The driving surface 22*a* of the pad driver 22 includes structure which engages the pad so that the pad is rotated with the pad driver whenever the drive motor (not shown) is energized. Referring also to FIGS. 2, 3 and 3A, the driving face 22*a* of the pad driver includes a plurality of sets of outwardly extending protrusions, indicated generally by the reference character 30. For purposes of explanation, the individual protrusions shall be referred to as "arrowheads". In the preferred and illustrated embodiment, and shown best in FIG. 2, each set of projections 30 preferably comprises a plurality of arrowhead members 32, arranged in a circular pattern. In the preferred and illustrated embodiment, these sets of arrowhead members 32 are arranged in linear patterns, best shown in FIG. 3. It should be understood, however, that nonlinear patterns, such as circular or arcuate patterns for these sets 30 of arrowhead members 32 are contemplated by the present invention.

Referring also to FIGS. 4–8, the pad driver 22 is preferably a molded product and the arrowhead members 32 are themselves integrally molded in the pad driver 22. The shape of each arrowhead character is best shown in FIGS. 4–8. Each arrowhead member 32 includes a stanchion 50 for supporting an arcuate crossbar 52, a spaced distance from a base surface 22' (see FIGS. 2, 3 and 3A) of the pad driver 22. In the preferred embodiment, the stanchion 50 is tapered in cross-section, such that a transverse dimension of the stanchion at the point where it joins the base surface 22' is similar to a transverse dimension of the arcuate crossbar 52.

Figure 4:
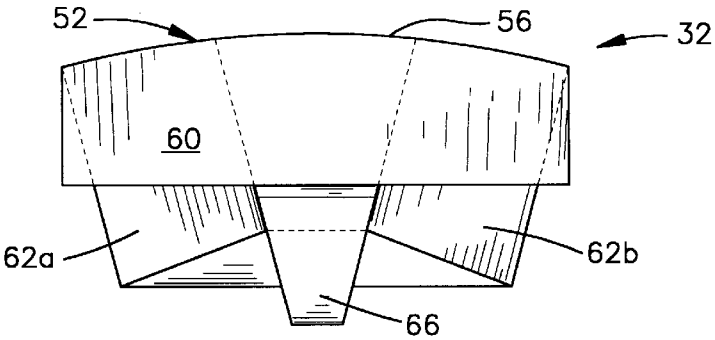
FIG. 4 is a top plan view of an arrowhead member that forms part of the pad driver.
Figure 6:
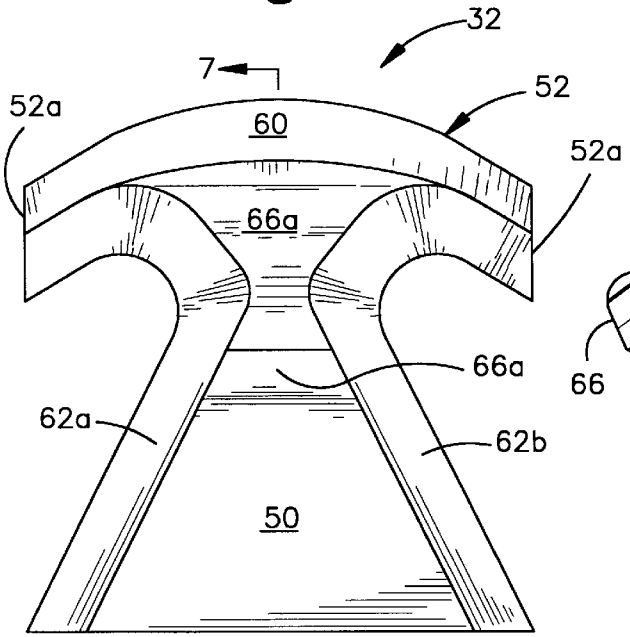
FIG. 6 is another side elevational view of the arrowhead member rotated 90° from the view shown in FIG. 5.
Figure 5:
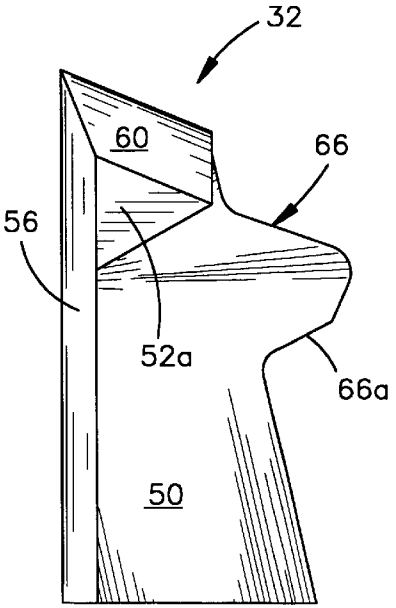
FIG. 5 is a side elevational view of the arrowhead member shown in FIG. 4.

As best seen in FIG. 4, and referring also to FIG. 2, an outboard face 56 of each arrowhead member 32 defines a uniform, arcuate surface. Preferably, the radius of the surface 56 is determined by the radius of the circle on which the set of arrowhead members are located. The center of the circle is indicated by the reference character 63. A top surface 60 of the arcuate crossbar 52 is angled downwardly toward the base surface 22'. In addition, chamfer-like surfaces 62*a*, 62*b* (see FIGS. 4 and 6) extend along the edges of the stanchion, as well as the underside of the crossbar 52. As a result, distal ends 52*a* of the crossbar 52 define a triangular shape (shown best in FIG. 5).

Each arrowhead member 32 includes an integrally formed camming nose 66 that extends inwardly and preferably radially with respect to a center point 63 (shown in FIG. 2) of the circle on which a set of arrowhead members are located. The camming nose 66 defines a camming surface 66*a*, the purpose of which will be described in connection with the molding process, that also forms part of the invention. In the preferred and illustrated embodiment, the camming surface defines an angle of substantially 28° with respect to a transverse line extending parallel to the base surface 22'. In the preferred embodiment, the inclined top surface of the crossbar defines an angle of substantially 22° with respect to the plane of the base surface 22'.

It is believed that the shape of the arrowhead members 32, particularly the arcuate crossbar 52 facilitates engagement with a polishing pad, etc. As is known, the pads (not shown) typically attached to the pad driver 22 are fibrous in nature. During installation, the fibers forming the pad move aside to enable the arcuate crossbar to "pierce" the pad. In effect, the individual fibers are urged transversely as the crossbar moves into the pad, such that the fibers ultimately move to the underside of the crossbar 52, thus providing a positive engagement between the pad driver 22 and the pad, while still allowing the pad to be removed from the pad driver 22 when desired.

Figure 11:
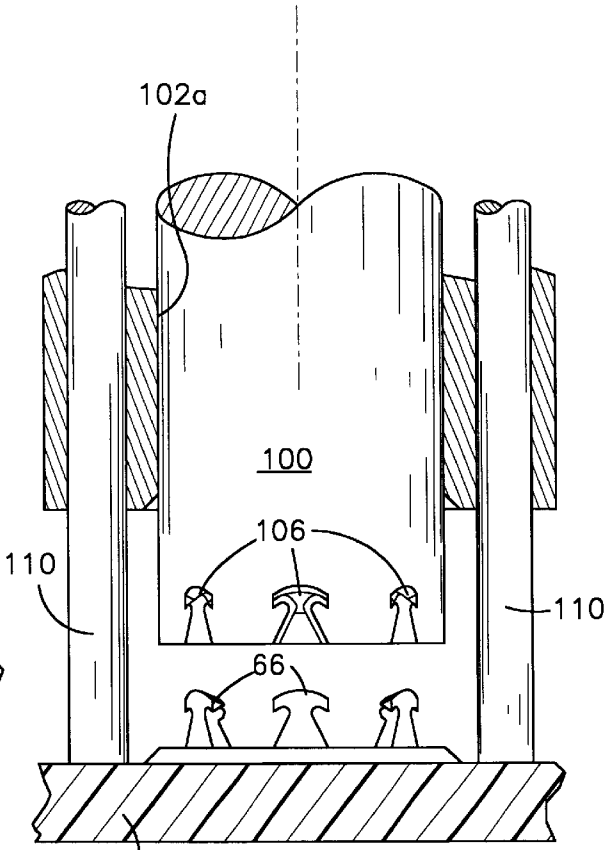
Figure 10:
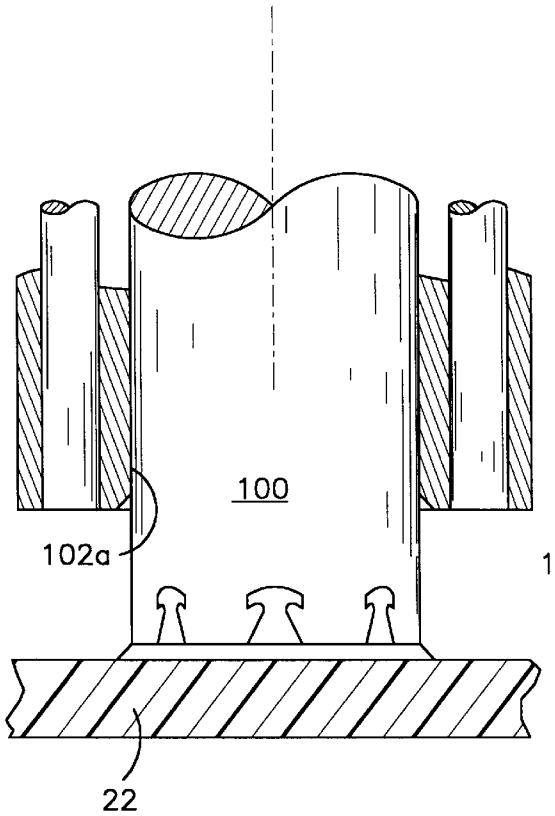
FIG. 10 is another view of the molding apparatus showing a cavity pin displaced from a molding plate; and, FIG. 11 is another view of the molding apparatus showing extension of ejection pins forming part of the molding apparatus.
Figure 9:
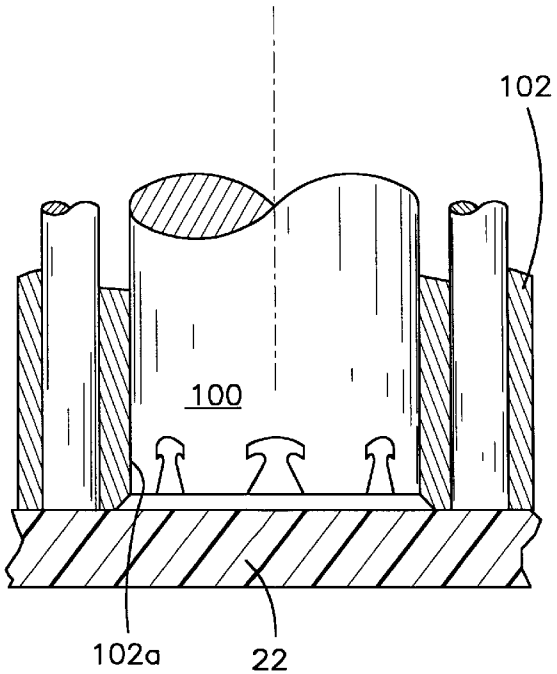
FIG. 9 is a fragmentary view, partially in section, showing a molding apparatus for molding the pad driver shown in FIG. 1.

Referring now to FIGS. 9–11, the method by which the sets 30 of arrowhead members 32 are molded is illustrated. Each set 30 of arrowhead members 32, which as described above, include a plurality of individual members arranged in a circular pattern, is formed by a cavity pin 100 in association with a cavity plate 102. As seen best in FIG. 11, each cavity pin 100 includes a plurality of recesses 106, each recess 106 defining the inner shape of a arrowhead member 32. In particular, the recess defines the arcuate crossbar 52 and the stanchion 50. The outboard surface 56 is defined by the cavity plate and, in effect, is a uniform cylindrical surface having a radius substantially the same as the outer radius of the cavity pin 100. Each cavity pin 100 is slidable in a hole 102*a* formed in the cavity plate 102.

Only the pertinent parts of the mold are illustrated. In FIG. 9, the mold and components are shown in the closed position. In this position, the molding compound is injected into the mold and fills the recesses defined between the cavity plate 102, the cavity pins 100 and a lower half of the mold (not shown). At the end of each injection step, the pad 22 including the pad base and the sets 30 of arrowhead members 32 are fully formed. Following the injection step, the cavity plate 102 is raised (as viewed in FIG. 10) so that the outboard surfaces 56 of the arrowhead members 32 are exposed. In this position, the arrowhead members 32 are no longer confined. Ejector pins 110 are then extended to push the molded pad driver away from the cavity pins 100. As the pad driver 22 moves away from the cavity pins 100, the individual arrowhead members 32 are cammed outwardly by the interaction between the recess 106 defined in the cavity pin 106 and the camming surface 66*a* of the camming nose 66, such that the members 32 bend outwardly a sufficient distance to enable disengagement of the arrowhead members 32 from the recesses 106 defined in the cavity pin 100.

With the disclosed molding technique, less expensive mold components can be used to produce a pad driver. In addition, maintenance is facilitated since individual cavity pins 100 can be replaced should an individual pin be damaged, etc.

Unlike prior art configurations, the arrowhead members 32 themselves are not linearly arranged, although the sets themselves may be arranged in a linear pattern, i.e., along radial or chord lines. When six members 32 are used in a set 30, each member is at a position that is rotated 60° with respect to the position of an adjacent arrowhead member 32. This varying orientation facilitates engagement of the arrowhead members with the fibrous pad, because it increases the number of arrowhead members that can penetrate the pad since the orientation of fibers in the pad are generally random.

Although the invention has been described with a certain degree of particularity, it should be understood that those skilled in the art can make various changes to it without departing from the spirit or scope of the invention as hereinafter claimed.

What is claimed is:

1. A pad driver for use with a floor maintenance machine having a pad drive motor, comprising:

a) structure defining a circular, disc-like body;

b) means for securing a floor maintenance pad to said body;

c) said body defining a driving surface abuttably engageable with a driven surface on said floor maintenance pad for exerting driving forces on said maintenance pad when said body is rotated by said motor;

d) said driving surface defining a plurality of sets of protrusions;

e) each set of protrusions comprising a plurality of protruding members arranged in a circular pattern, such that each protruding member of a set is at a slightly different orientation with respect to all other members of a set as viewed from a plane parallel to a plane of said body.

2. The pad driver of claim 1, wherein each protruding member comprises an arrowhead member including a stanchion extending from a base surface on said body, axially outwardly and terminating in a cross bar which extends generally laterally with respect to a rotational axis of said body.

3. The pad driver of claim 2, wherein said cross bar of each arrowhead member is arcuate.

4. The pad driver of claim 2, wherein said base surface defines a pedestal for each set of arrowhead members, said pedestal being spaced axially with respect to the overall driving surface.

5. The pad driver of claim 2, wherein each arrowhead member defines a camming nose including a camming surface which facilitates release of said arrowhead member from a molding surface used to mold the arrowhead member.

6. The pad driver of claim 5, wherein said camming surface defines an angle of substantially 28° with respect to a transverse line extending parallel to the base surface.

7. The pad driver of claim 2, wherein said sets of arrowhead members are arranged in a linear pattern on said body.

8. The apparatus of claim 2, wherein said arrowhead members of a set are arranged on a circle, each member being at a common radial distance as measured from a center of the circle on which said members are located.

9. The apparatus of claim 8, wherein each arrowhead member includes a radiused, outer surface, with respect to said center of said circle.

10. The apparatus of claim 2, wherein said stanchion and said crossbar include champhered surfaces.

11. The apparatus of claim 10, wherein distal ends of said crossbar are triangular in cross-section.

12. The apparatus of claim 2, wherein a top surface of said crossbar is angled downwardly towards the base surface.

13. The pad driver of claim 12, in which said top surface of said crossbar defines an angle substantially 22° with respect to a plane defined by said base surface.

* * * * *